United States Patent [19]

Ishiba

[11] 4,144,734

[45] Mar. 20, 1979

[54] INDIRECT EXTRUSION PROCESS AND APPARATUS

[75] Inventor: Jintaro Ishiba, Namerikawa, Japan

[73] Assignee: Yoshida Kogyo K.K., Tokyo, Japan

[21] Appl. No.: 773,147

[22] Filed: Mar. 1, 1977

[30] Foreign Application Priority Data

Mar. 1, 1976 [JP] Japan ..... 51-21954

[51] Int. Cl.[2] ..... B21C 26/00; B21C 35/04

[52] U.S. Cl. ..... 72/253 A; 72/255; 72/273

[58] Field of Search ..... 72/253 R, 255, 273, 72/253 A, 254

[56] References Cited

U.S. PATENT DOCUMENTS

| | | | |
|---|---|---|---|
| 2,165,711 | 7/1939 | Kreidler | 72/253 X |
| 3,735,623 | 5/1973 | Mann | 72/272 |
| 4,056,964 | 11/1977 | Shibasaki | 72/273 |

FOREIGN PATENT DOCUMENTS

| | | | |
|---|---|---|---|
| 1127305 | 4/1962 | Fed. Rep. of Germany | 72/273 |
| 2237276 | 2/1973 | Fed. Rep. of Germany | 72/254 |
| 2319036 | 10/1974 | Fed. Rep. of Germany | 72/254 |

*Primary Examiner*—C.W. Lanham
*Assistant Examiner*—D. M. Gurley
*Attorney, Agent, or Firm*—Hill, Gross, Simpson, Van Santen, Steadman, Chiara & Simpson

[57] ABSTRACT

A die holder has adjacent to its front end an annular step portion comprising a steep wall and a gradual wall tapered from the steep wall to the front end, the annular step portion being adapted to provide an annular space between the step portion and an inner surface bounding a billet receiving bore in a container when the die holder is inserted in the bore. During indirect extrusion, foreign impurities such as dirt, lubricant, metal oxides, and the like deposited between the bore surface and the billet are trapped and collected in the annular space against entrainment into an extruded product being formed. An annular ring partly defining the steep wall acts as a barrier that prevents the impurities from getting therepast and minimizes skull formation on the bore surface. An annular butt formed by accumulations of the impurities in the annular space and a butt end of the billet are removed from the container by means of a shear.

1 Claim, 8 Drawing Figures

INDIRECT EXTRUSION PROCESS AND APPARATUS

BACKGROUND OF THE INVENTION

1. Field of the Invention

The present invention relates to an indirect extrusion process.

2. Prior Art

The indirect extrusion process has advantages in that friction between the billet and the container wall defining a billet receiving bore is practically eliminated, and there is almost no turbulent metal flow in the billet, thereby reducing extruding force. Further, surface layers of the billet can be extruded, since there is no need of leaving in the container a thin sleeve of the billet which would otherwise be produced by a dummy block during direct extrusion for preventing surface friction and entrainment of surface oxides into the extruded product.

A major problem with the indirect extrusion method is the accumulation of skull on the bore wall in the container. The skull comprises accumulations of unwanted materials on the container wall and may include a layer of unextruded metal, dirt, lubricant, metal particles produced when the outer periphery of a die holder is held in frictional contact with the bore wall, and metal oxides formed on the billet during homogeneous heat treatment before extrusion. These foreign impurities, deposited between the metal billet and the container wall, find their way into the products during extrusion and appear as flaws on the finished products, thereby lessening their quality and possibly rendering them defective.

Various attempts have been made in the past to remove such skull in order to assure an efficient indirect extrusion operation. One typical effort has been a skim block shown in U.S. Pat. No. 3,184,944, issued May 25, 1965. The skim block has an outer surface shaped to provide a precisely controlled sliding fit between the skim block and the container bore. The skim block is moved through the container for removal of the accumulated materials after an indirect extrusion process is completed. With this type of arrangement, the block itself must be carefully machined to avoid damage or excessive wear to the bore wall, and skull skimming through the container increases down time of the extrusion press.

Another die holder that has been suggested for preventing skull formation is described in U.S. Pat. No. 3,522,721, issued Aug. 4, 1970. The separate die holder has an outer sealing surface that is configured also to provide a closely controlled sliding fit between the outer sealing surface and the container bore wall. The sealing surface involves careful machining. Further, the die holder allows the impurities to get into the extruded product as the billet is extruded.

SUMMARY OF THE INVENTION

The method of the invention can be utilized using a stationary die holder in which a die is supported has near its front end an annular step portion comprising a steep wall and a gradual wall tapered from the steep wall to the front end. When the die holder is inserted in a container, there is provided an annular space between the step portion and the container bore in which a billet is loaded. As the container slides over the die holder to extrude the billet through the die, foreign impurities such as dirt, lubricant, metal oxides, for example, accumulated between the bore surface and the billet are trapped and compacted in the annular space, and prevented from getting into an extruded product being formed. The die holder has an annular ring contiguous to the step portion, the ring serving to minimize skull formation on the bore surface. An annular butt formed by the collected impurties and a butt end of the billet left upon completion of an extrusion process are successively removed from the container by means of a shear.

Accordingly, it is an object of the present invention to provide a process of and means for indirectly extruding a billet while collecting foreign impurities to prevent formation of flaws and deposit of foreign materials on the extrusion. A further object of the present invention to provide a process of indirectly extruding a billet while collecting foreign impurities as an annular butt that is ready for removal upon completion of the extrusion process.

A still further object of the present invention is to provide an indirect extrusion process including the steps of removing butt portions of a billet from a container.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION OF THE PREFERRED EMBODIMENT

Figure 1:
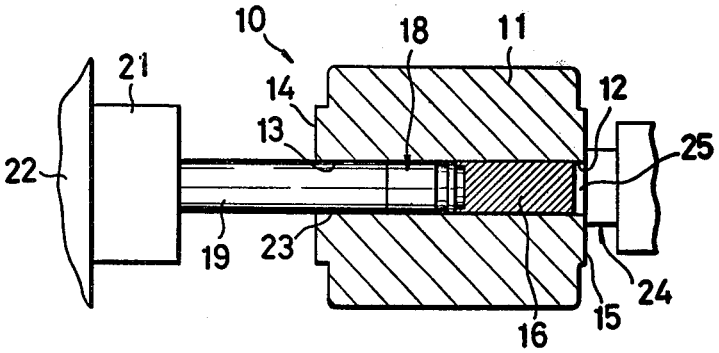
FIG. 1 is a schematic cross-sectional view of an indirect extrusion apparatus used for carrying out an indirect extrusion process of the present invention.

FIG. 1 shows an indirect extrusion apparatus or press 10 having a container 11 with a concentric bore 12 defined by a cylindrical inner wall or surface 13 and opening into the ends 14,15 of the container 11. Within the bore 12 is disposed and confined a billet 16 of a material to be extruded by an extrusion die 17 (FIG. 3) supported in a die assembly. The die assembly comprises a die holder 18, and a hollow stem portion 19 secured at its ends coaxially between the die holder 18 and a die stem support 21 fixed to a press frame 22. The die assembly has an outer peripheral surface 23 having a close sliding fit between the peripheral surface 23 and the bore surface 13. With the die holder 18 inserted partly in the bore 12, the container 11 can be pressed toward the support 21 by means of a main ram 24 having a small-diameter front end 25 retained in the bore 12 against displacement.

Figure 2:
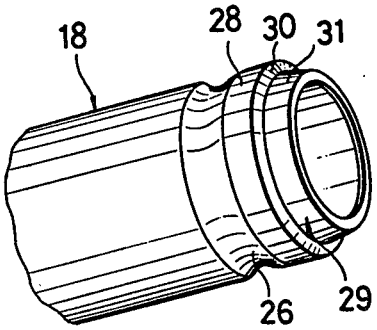
FIG. 2 is an enlarged fragmentary perspective view of a die holder apparatus shown in FIG. 1.
Figure 3:
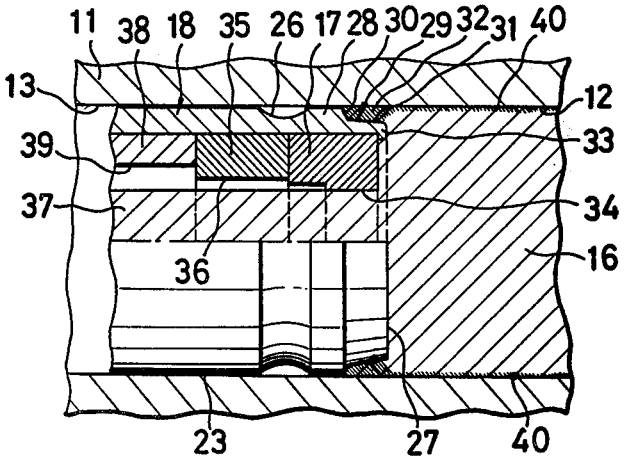
FIG. 3 is an enlarged fragmentary cross-sectional view of a portion of FIG. 1.

As shown in FIGS. 2 and 3, the die holder 18 has an annular recess 26 formed adjacent to but spaced from a front end 27 of the holder 18 to leave an annular ring portion 28 contiguous to the recess 26, the ring portion 28 having substantially the same outer diameter as that of the surface 23 of the die assembly. The ring portion 28 is defined partly by an annular step 29 which is composed of a steep wall 30 adjoining to the ring portion 28 and a gradual wall 31 tapered from the steep wall 30 toward the front end 27, leaving an annular space 32 between the inner bore surface 13 and the step 29.

The front end 27 of the die holder 18 has a radially inwardly extending flange 33 against which is held the die 17 having an orifice 34 through which the billet material 16 can be extruded. The die 17 is held in place by a die backer 35 having an opening 36 larger in diameter than the die orifice 34 for the passage therethrough of an extrusion 37 being formed. The die backer 35 is supported by a bolster 38 having a larger-diameter opening 39 through which the extrusion 37 can pass.

For an extruding operation, the billet 16 is inserted into the container 11 by a suitable billet loader (not shown) and the die holder 18 is placed partly in the container bore 12 at the end 14, with the die 17 being supported in position within the die holder 18. Then, the main ram 24 is actuated to push the billet-loaded container 11 toward the die stem support 21, and as the bore surface 13 slides over the stationary die holder 18, the billet 16 is extruded through the die orifice 34.

As the container 11 moves relatively to the die holder 18, the bore surface 13 is held in frictional contact with the outer surfaces of the stem portion 19 and the annular ring 28, with the result that the outer surfaces are worn little by little to produce metal particles. Dirt and lubricant become deposited on the bore surface 13 as an extrusion cycle is repeated. Further, the billet 16 carries on its surface metal oxides produced during homogeneous heat treatment prior to and preparatory for extrusion. While the billet 16 is being extruded, these foreign impurities 40 accumulated between the bore surface 13 and the billet 16 are blocked by the steep wall 30 and prevented from getting past the annular ring 28. As an extrusion process proceeds, the blocked impurities 40 are trapped and compacted in the space 32, and are prevented by the gradual wall 31 from getting out even under the influence of metal flow in the billet 16 that concentrates in the vicinity of the die 17. Thus, an extruded product is substantially free from foreign materials such as dirt, lubricant, metal oxides, and the like. Further, since the annular ring 28 is closely fitted in the bore 12, the ring 28 serves as a barrier to hold skull formation at a minimum while an extrusion cycle is in progress. The die holder 28 thus constructed is advantageous in that it can be installed on existing indirect extrusion presses.

Figure 4:
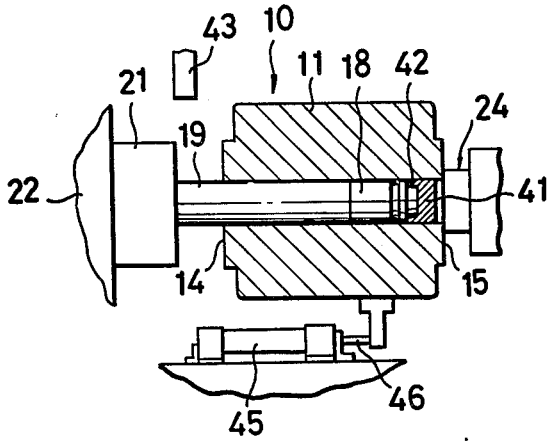
FIGS. 4 through 8 show successive steps of removing billet butt portions from the container.

The main ram 24 is continuously advanced until the billet 16 is substantially completely extruded so that a butt end 41 of the billet 16 remains within the container as illustrated in FIG. 4. The butt end 41 is joined to the extruded product and to an annular butt 42 formed by accumulation of the impurities 40 in the space 32. To remove these butt portions 41 and 42 there are provided a gate or spacer 43 on the side of the die stem support 21, a shear 44 on the side of the main ram 24, and a suitable hydraulic cylinder 45 having a piston rod 46 attached to the container 11. The gate or spacer 43 is in the form of an inverted U and is vertically movable between a lower position in which it straddles the die stem portion 19 adjacent to the die stem support 21 and an upper portion above the container 11. When the gate 43 is in the lower position and is sandwiched between the support 21 and the container 11, the shear 44 can slide over the end 15 of the container 11 that faces the main ram 24. The gate 43 has a thickness such that when it is interposed between the support 21 and the container 11, the front end 27 of the die holder 18 is substantially flush with or slightly recessed from the end 15 of the container 11.

Figure 5:
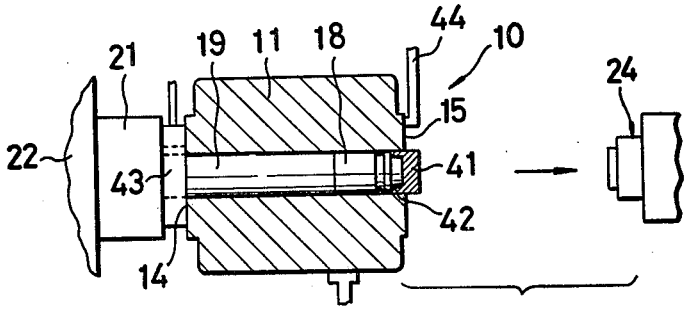
Figure 6:
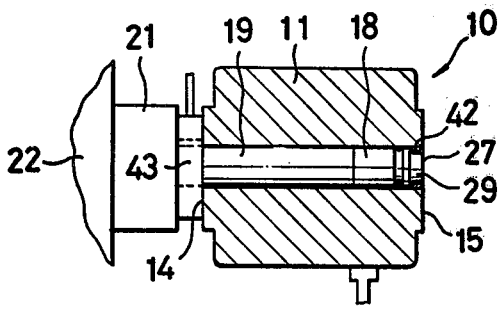
Figure 7:
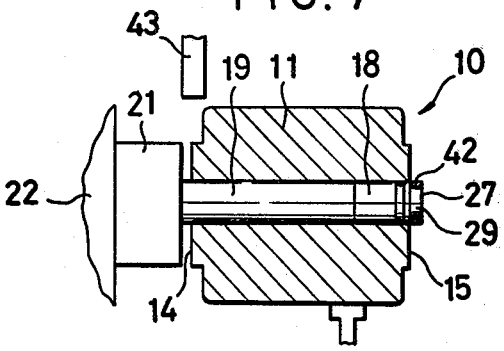
Figure 8:
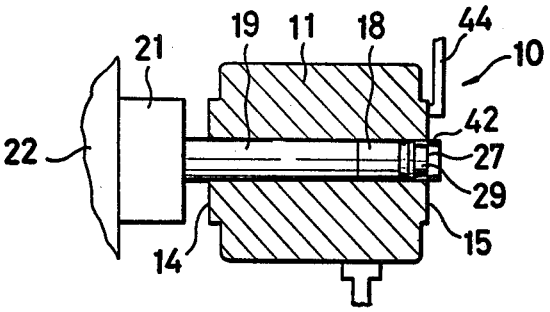

In operation, the main ram 24 is retracted upon completion of an extruding stroke, and the gate 43 is lowered to its lower position. Then, the piston rod 46 is actuated to move the container 11 toward the support 21 until the container 11 is held against the support 21 with the gate 43 sandwiched therebetween. At this time, the butt end 41 projects beyond the container end 15 as shown in FIG. 5. The shear 44 is moved downwardly to cut off the butt 41, and the extrusion can be taken out of the extrusion press 10. After shearing of the butt 41, the shear 44 is withdrawn (FIG. 6), and the gate 43 is raised to the upper position (FIG. 7). The piston rod 46 is again actuated to shift the container 11 further toward the support 21 until the radially compressed annular butt 42 around the step 29 projects beyond the container end 15 as illustrated in FIG. 7 at which time the butt 42 deforms by radial expansion. Then, the piston rod 46 is moved in the opposite direction to return the container 11 away from the support 21. As the conatiner 11 is moved back, the annular butt 42 is withdrawn from the step 29 of the die holder 18, while the annular expanded butt 42 is retained by the container 11 against re-entry into the container bore 12. The motion of the container 11 is stopped when the front end 27 of the die holder 18 is withdrawn into the bore 12 (FIG. 8). The shear 44 is lowered again to remove any butt 42 from the container end 15 which may not have fallen off due to gravity.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An indirect extrusion process utilizing a ram confronting a support, a die holder rigidly fixed at one end to the support and a container having a through-bore defined by an inner surface, the die holder supporting an orificed die within the other end and having a peripheral surface around the die with a close sliding fit with said inner surface, there being an annular step portion in the die holder adjacent to said other end, comprising the steps of:

a. loading a billet in the bore;

b. inserting said other end of the die holder into the bore;

c. actuating the ram to engage the billet and to move the container to slide over the die holder so as to extrude the billet through the die orifice;

d. simultaneously with the moving step, collecting impurities originating from the surface of the original billet and deposited between said inner surface and the extruded part of the billet, and passing in radially spaced relation to the die, as an annular butt around the annular step portion and trapped thereby out of any engagement with the die;

e. Thereafter moving the container toward the support until a butt end of the billet, joined to an extruded product and the annular butt, projects beyond an end of said container;

f. cutting off said butt end;

g. moving the container further toward the support until the annular butt projects beyond the container end and thus expands a bit radially;

h. moving the container away from the support while also withdrawing the distal end of the die holder and the die into the container, thus leaving only said annular butt on the container end; and i. removing said annular butt from the container.

* * * * *